United States Patent [19]

Elder

[11] Patent Number: 4,967,455

[45] Date of Patent: Nov. 6, 1990

[54] CASKET AND METHOD OF MANUFACTURE

[75] Inventor: Bruce E. Elder, Royal Oak, Mich.

[73] Assignee: Vandor Corporation, Rochester, Mich.

[21] Appl. No.: 488,468

[22] Filed: Feb. 26, 1990

Related U.S. Application Data

[63] Continuation of Ser. No. 167,401, Mar. 14, 1988, abandoned, which is a continuation of Ser. No. 538,124, Oct. 3, 1983, Pat. No. 4,730,370.

[51] Int. Cl.[5] ..... A61G 17/00

[52] U.S. Cl. ..... 27/4; 27/14; 27/19

[58] Field of Search ..... 127/2, 3, 4, 14, 19, 127/35; 220/443, 460; 229/DIG. 2, DIG. 4, DIG. 5, 87 R, 192, 193; 206/320

[56] References Cited

U.S. PATENT DOCUMENTS

| | | | |
|---|---|---|---|
| 80,816 | 8/1868 | Erarts | 27/7 |
| 123,781 | 2/1872 | Keenan | 27/7 |
| 172,482 | 1/1876 | Pitman | 27/7 |
| 212,655 | 2/1879 | Buck | 27/7 X |
| 296,782 | 4/1884 | Rappleyea | 27/19 |
| 668,883 | 2/1901 | Post | 27/7 |
| 678,348 | 7/1901 | Nichols | 27/3 |
| 768,481 | 8/1904 | Post | 27/2 |
| 1,128,865 | 2/1915 | Freeman | 27/35 |
| 1,234,180 | 7/1917 | Kersten | 27/3 |
| 1,507,957 | 9/1924 | Edwards | 27/3 |
| 1,660,019 | 2/1928 | Tazza | 27/2 |
| 1,903,197 | 3/1933 | Scott | 27/3 |
| 1,903,198 | 3/1933 | Scott | 27/3 |
| 1,960,391 | 5/1934 | Newhouse | 229/193 |
| 1,989,962 | 2/1935 | Zinser et al. | 27/3 |
| 2,111,337 | 3/1938 | Sherman | 27/3 |
| 2,338,035 | 12/1943 | Gerold | 27/14 |
| 2,448,923 | 9/1948 | Skolnik | 27/3 |
| 2,494,473 | 1/1950 | Dowling | 27/3 |
| 2,521,184 | 9/1950 | Paige | 45/31 |
| 2,664,615 | 1/1954 | Hillenbrand et al. | 27/19 |
| 2,947,059 | 8/1960 | Hillenbrand | 27/19 |
| 2,974,390 | 3/1961 | Nelson | 27/7 |
| 3,164,880 | 1/1965 | Hotchkiss | 27/3 |
| 3,220,080 | 11/1965 | Connelly | 27/2 |
| 3,469,762 | 9/1969 | LaTorre | 229/32 |
| 3,480,137 | 11/1969 | Wallace | 220/460 |
| 3,490,114 | 1/1970 | Connelly et al. | 27/2 |
| 3,490,114 | 1/1970 | Connelly et al. | 27/2 |
| 3,729,786 | 5/1973 | Walding | 27/3 |
| 3,879,818 | 4/1975 | Rowland | 27/7 |
| 4,034,447 | 7/1977 | Kollmann et al. | 27/2 |
| 4,041,582 | 8/1977 | MacDonald | 27/2 |
| 4,063,337 | 12/1977 | Havey | 27/2 |
| 4,123,831 | 11/1978 | Covington | 27/2 |
| 4,124,421 | 11/1978 | Fujii | 156/87 |
| 4,151,630 | 5/1979 | Havey | 27/2 |
| 4,154,388 | 5/1979 | Hall | 229/193 |
| 4,156,956 | 6/1979 | Partridge et al. | 27/4 |
| 4,176,431 | 12/1979 | Havey | 27/2 |
| 4,209,880 | 7/1980 | Lindholm | 27/2 |
| 4,399,596 | 8/1983 | Parlour et al. | 27/4 |

FOREIGN PATENT DOCUMENTS

| | | | |
|---|---|---|---|
| 2402470 | 7/1974 | Fed. Rep. of Germany | 27/4 |
| 2608058 | 9/1977 | Fed. Rep. of Germany | 27/2 |
| 61994 | 7/1982 | Finland | 27/4 |
| 574332 | 3/1958 | Italy | 220/460 |
| 7907743 | 4/1981 | Netherlands | 27/4 |
| 82/04186 | 12/1982 | PCT Int'l Appl. | 27/4 |

*Primary Examiner*—Richard J. Johnson

*Attorney, Agent, or Firm*—John T. Synnestvedt

[57] ABSTRACT

A casket and method for manufacture are disclosed according to which a shell or base, having outwardly flared walls, is constructed of corrugated fiberboard by a technique in which a planar sheet of corrugated fiberboard is cut to form a blank having interconnected portions corresponding to the areas of the flared side and end walls. A domed lid is also provided, being formed of corrugated fiberboard with a reinforcing marginal frame, provision being made for utilization of the lid either as a single unitary piece or as a split lid having two halves.

1 Claim, 6 Drawing Sheets

CASKET AND METHOD OF MANUFACTURE

This application is a continuation of application serial no. 07/167,401 filed Mar. 14, 1988, abandoned, which is continuation of serial no. 06/538,124, filed Oct. 3, 1983, Patent No. 4,730,370.

BACKGROUND AND STATEMENT OF OBJECTS

The use of wood in fabricating caskets is well-known; and in addition, limited use has been made of certain other materials, including corrugated fiberboard.

The present invention is concerned with novel casket structure and novel manufacturing techniques for making caskets, employing corrugated fiberboard as the base material.

One of the principal objects of the invention is the provision of a technique by which a shell or base of a casket, having flared side and end walls, is fabricated from a single blank cut from a planar sheet of the corrugated fiberboard, the blank having interconnected portions corresponding to the areas of the flared side and end walls. In this way, an exceedingly simple fabrication technique is provided,, notwithstanding the flared configuration of the side and end walls.

The invention further provides a simplified technique for fabrication of a domed lid from corrugated fiberboard, the lid having a marginal frame and being constructed so that the lid may be used in a single piece covering the entire casket or in the form of a split lid in which two halves are provided, being separately mounted so that one half may be raised independently of the other, as is frequently desired in connection with viewing procedures.

The invention provides various specific manufacturing operations which facilitate the fabrication of the base or shell of the coffin as well as of the domed lid.

By virtue of these techniques, the invention provides a highly satisfactory and practicable configuration and method which can be carried out by the use of corrugated fiberboard, particularly corrugated fiberboard having a multiplicity of layers of corrugated material incorporated in the board.

The techniques of the invention not only provide for the fabrication of casket shells and lids which are of high strength, but which are also of relatively light weight. With a typical construction of the casket and lid according to the present invention, the total weight may be of the order of 50 lbs., as compared with a corresponding weight of 150 lbs. where the casket and lid are formed of wood.

Still further, the invention contemplates novel configuration of various parts of both the shell and the lid so as to facilitate the application to both components of fabric covering, commonly used and widely accepted.

BRIEF DESCRIPTION OF THE DRAWINGS

How the foregoing and other objects and advantages are attained will appear more fully from the following description referring to the accompanying drawings, in which:

FIG. 15*a* is a view of the blank of FIG. 9, with certain portions corresponding to the end wall areas of the casket flexed into the planes of the end walls;

FIG. 15*b* is a view similar to FIG. 15*a* but illustrating additional flexing of portions of the blank;

FIG. 15*c* is a view of the casket shell with all portions of the planar blank folded into the desired wall positions, this view also showing certain frame elements adapted to be assembled with the folded blank;

FIG. 15*d* is a view showing the assembled parts of the shell and also showing portions of the domed lid adapted to be assembled into the configuration in which the lid is formed in one piece;

FIG. 15*e* is a view similar to FIG. 15*d* but showing the lid components assembled in a manner to provide a lid in a single piece;

FIG. 15*f* is a view of a casket shell and domed lid assembled together but showing the subdivision of the lid of FIG. 15*e* into two parts so that they may be separately handled;

DETAILED DESCRIPTION OF THE DRAWINGS

Figure 1:
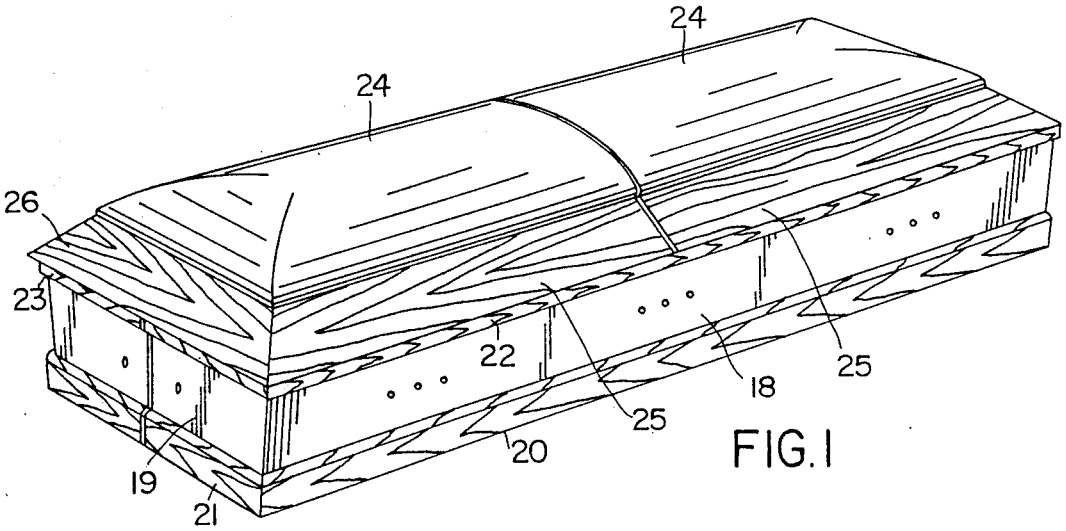
FIG. 1 is a perspective view of a casket shell having flared side and end walls and with a domed lid applied, this view showing these portions of the casket as constructed in accordance with the present invention, but prior to the application of the fabric covering.

Various of the major components of the casket shell and lid are referred to just below in connection with the overall perspective views of FIGS. 1, 2 and 3. In FIG. 1, the flared side and end walls are generally indicated at 18 and 19. Frame elements 20 extend along the lower edge of the side walls 18, and framing elements 21 are provided at the lower edges of the end walls. Additional framing elements 22 extend along the upper edge of the side walls, and additional elements 23 extend along the upper edges of the end walls. The domed lid comprises a central domed portion 24 with side edge framing elements 25,25 along the side edges, and with framing elements 26 along the ends of the lid. In FIG. 1, it will be noted that the central domed portion of the lid and the side edge framing are both formed in two parts.

Figure 2:
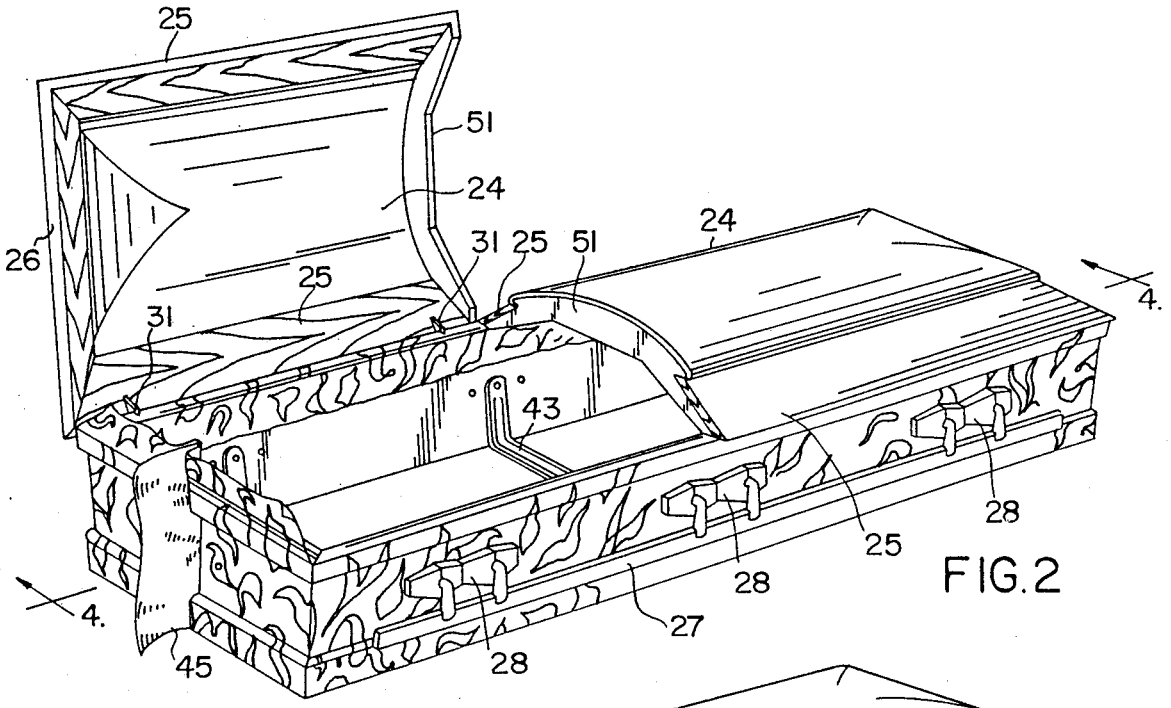
FIG. 2 is a view similar to FIG. 1 but illustrating the flared shell with fabric in the process of being applied, this view also showing one half of a split lid in open position.

The structure shown in FIG. 2 is the same as that shown in FIG. 1 except that fabric covering and certain hardware elements are applied. In FIG. 2, the left hand portion 24 of the domed lid is shown in raised position, and the other portion 24 is shown in closed position. The shell of the casket, as shown in FIG. 2, has also been covered with a fabric, the texture of which is indicated diagrammatically. FIG. 2 also shows one stage of application of the fabric (toward the left end of the figure) in a manner which will be described more fully hereinafter. In FIG. 2, hardware, including the extended handrail or bar 27, is shown mounted along the side of the shell as by the escutchepn and hinge plates 28. A similar handle 29 may be mounted by the escutcheon 30 at the end of the shell, this latter component being illustrated only in FIGS. 3 and 4.

Figure 3:
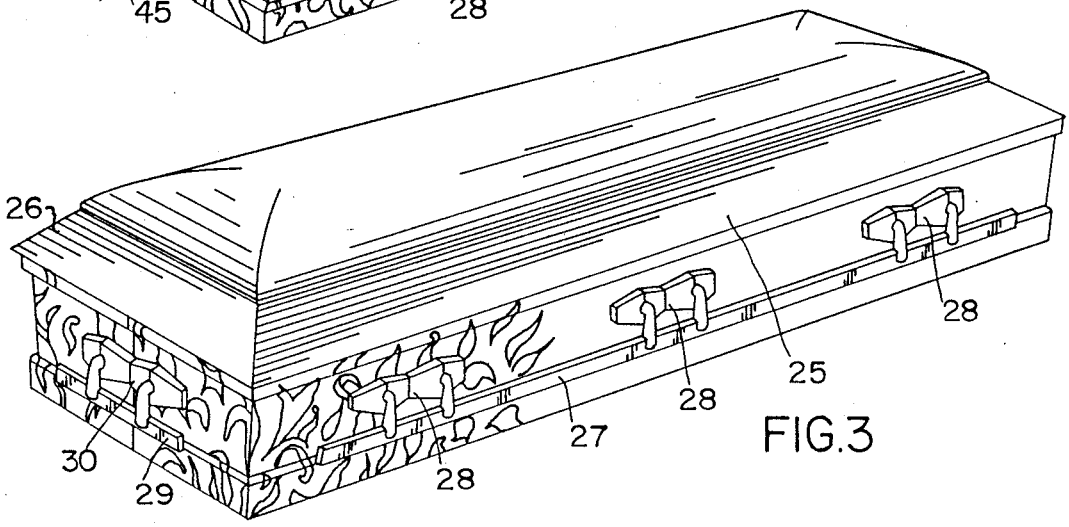
FIG. 3 is a view similar to FIG. 1 but illustrating a completed casket shell and lid, with fabric applied to the shell and with the lid shown as being formed in one piece.

In FIGS. 1 and 2, the lid is formed in halves, as above noted, whereas in FIG. 3, the lid structure comprises only a single piece. The invention provides alternatively for either single-piece or split-lid construction from the same constituents or materials, as is explained more fully hereinafter with particular reference to FIGS. 15*d*, 15*e*, 15*f* and 16. Hinges, preferably in detachable form and diagrammatically indicated at 31, are provided for the lid in a manner well understood in this art.

Figure 5:
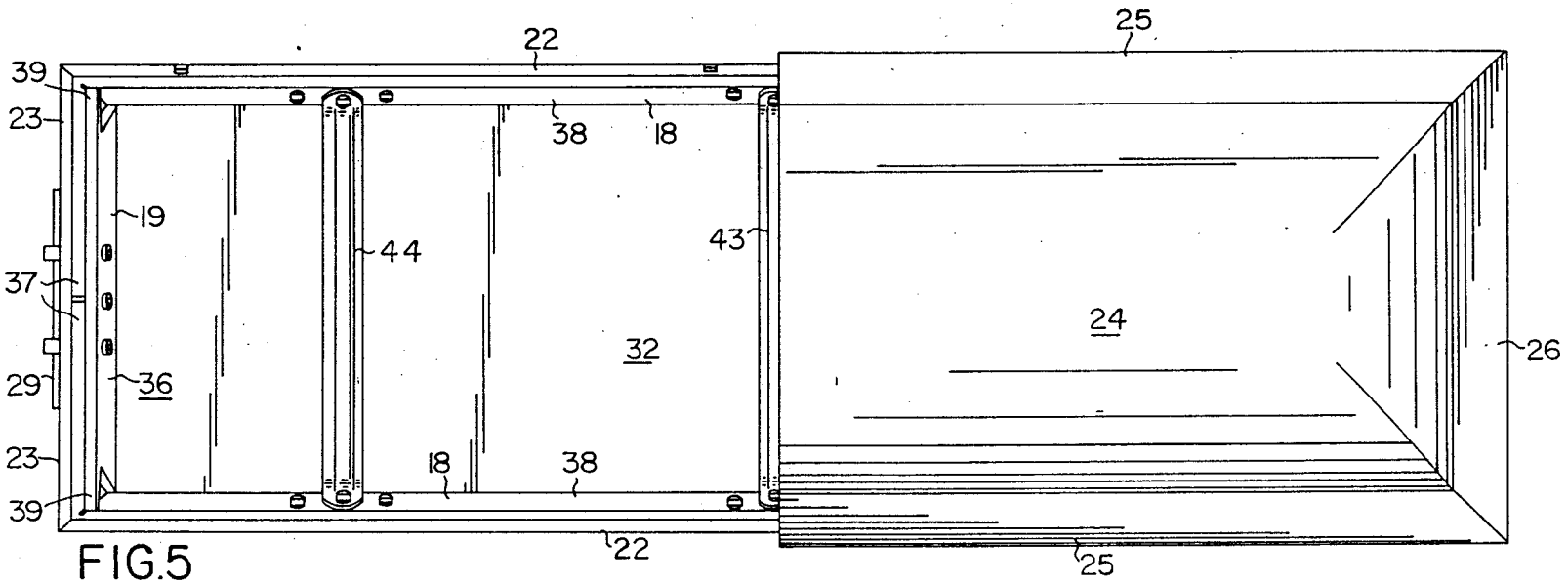
FIG. 5 is a top plan view of the casket shell and lid shown in FIG. 4.
Figure 4:
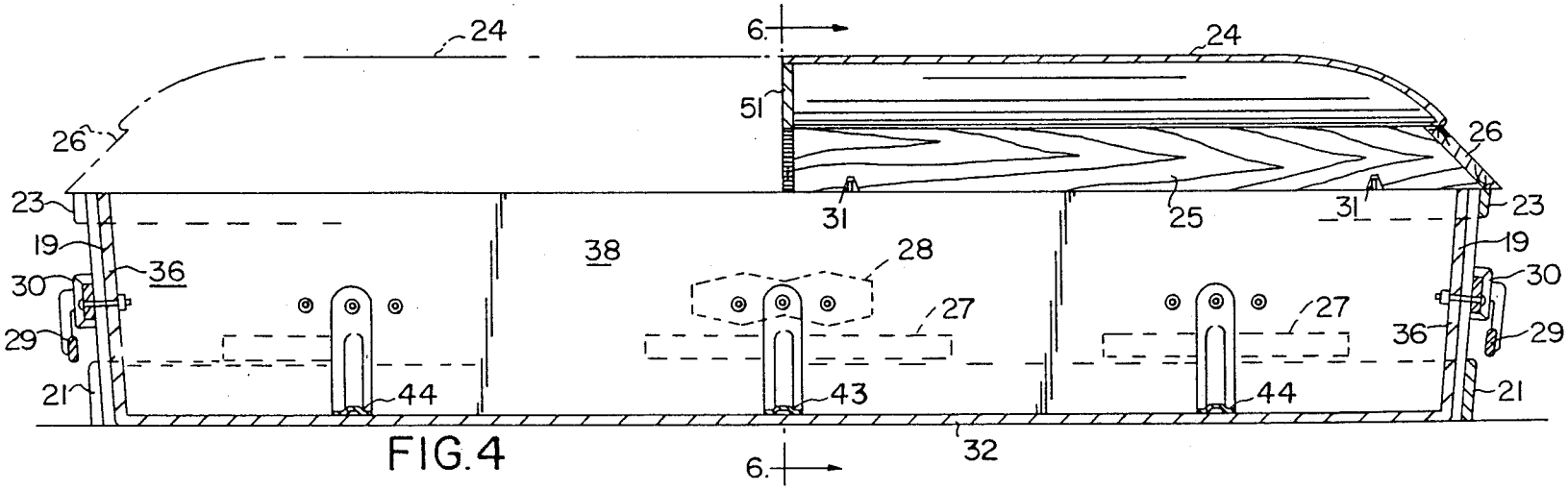
FIG. 4 is a longitudinal sectional view taken as indicated by the section line 4—4 on FIG. 2.
Figure 6:
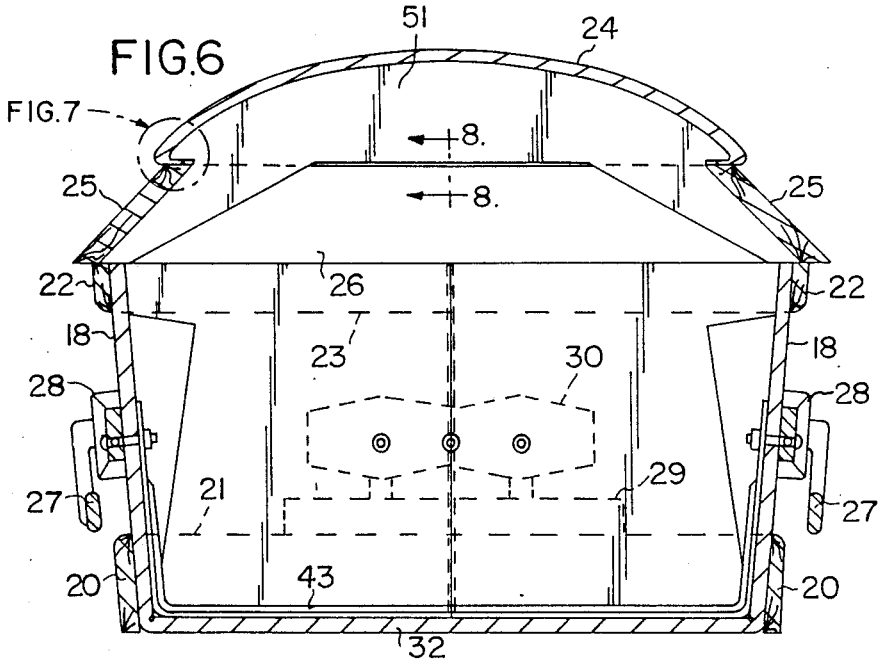
FIG. 6 is a transverse sectional view taken as indicated by the section line 6—6 on FIG. 4.

The bottom wall of the casket may be seen in FIGS. 4 and 6, being indicated at 32, the two flared side walls again being indicated at 18,18 and the end walls at 19,19. The domed lid appears at 24 and the side and end framing elements for the lid at 25 and 26, as in FIGS. 1, 2 and 3. The lower and upper edging or frame elements of the shell are also indicated in FIGS. 4, 5 and 6 by the same numerals as in FIGS. 1, 2 and 3.

In FIGS. 1 to 6 inclusive, none of the walls of the casket or lid are shown in detail; and it is to be understood that the principal wall elements are all formed of corrugated fiberboard in accordance with the technique of the present invention.

Figure 9:
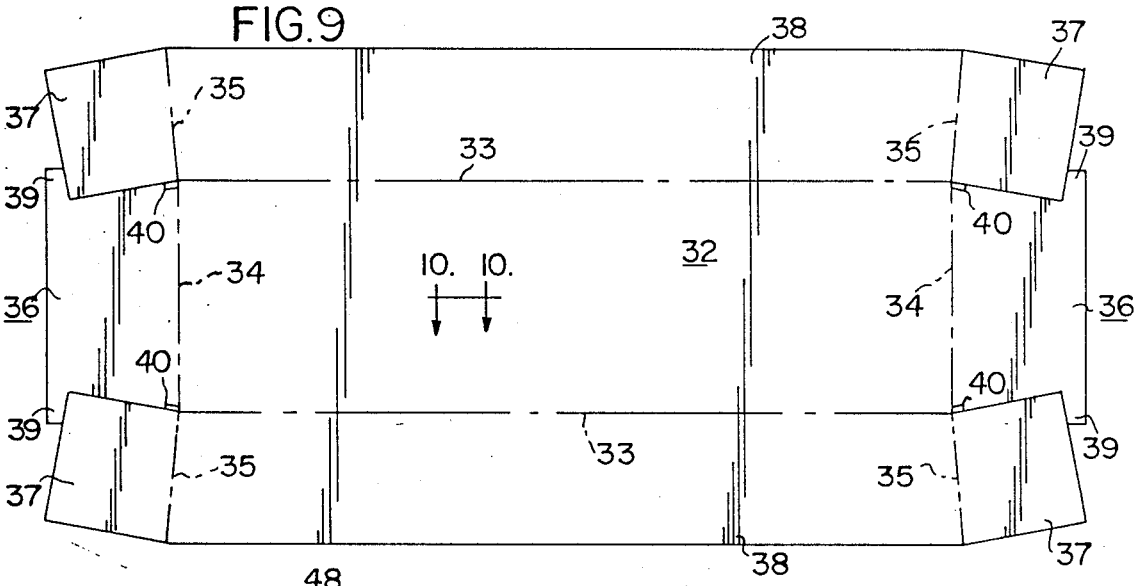
FIG. 9 is a plan view of a blank cut from a planar sheet of corrugated fiberboard and having dot-dash lines applied to indicate lines on which flexing of various areas of the planar blank will be effected in order to form a casket shell.
Figure 10:
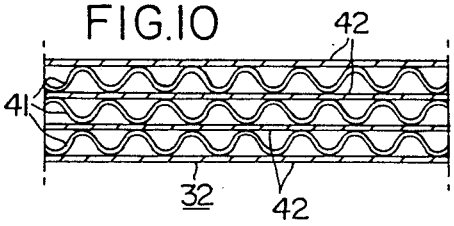
FIG. 10 is an enlarged sectional view taken as indicated by the line 10–10 on FIG. 9 and showing the multiple-layered corrugated fiberboard employed.

The method of fabricating the casket shell provided according to the invention includes the principal steps described herebelow, chiefly in connection with FIGS. 9, 10, 15*a* and 15*b*. According to the invention, the shell walls are formed of corrugated fiberboard, for instance, the triple-layered fiberboard, such as indicated in FIG. 10. Such board is available in planar sheets from which appropriate blanks may be cut. FIG. 9 shows the configuration of a blank cut from a planar sheet of multi-layered corrugated fiberboard of the kind shown in FIG. 10. The blank shown in FIG. 9 in its planar form comprises areas or portions corresponding to the bottom wall, the side walls and the end walls of the flared shell of the casket. More specifically, the bottom wall area lies within the two score lines indicated at 33—33 defining the width of the bottom of the shell, and by the two score lines 34—34 defining the length of the bottom of the shell. Score lines at 35—35 at each side of the blank define the ends of the flared side wall at the respective sides. The areas 36 beyond the lines 34 correspond, in general, to the areas of the end walls of the shell; and as is described hereinafter with reference to FIG. 15*a*, those areas 36 are adapted to be folded upwardly into the flared end wall planes in order to define most of the area of the end walls of the shell. The areas 37 lying beyond the lines 35 constitute supplemental end wall areas, each representing one half of an end wall of the flared shape of the shell; and these areas 37 are adapted to be folded over the previously folded areas 36 at the ends, in the manner clearly shown in FIG. 15*b*. The side walls of the flared shell are indicated at 38; and from FIGS. 15*a* and 15*b*, it will be understood that the side wall areas 38 are folded upwardly into the flared planes of the side walls prior to the folding of the supplemental areas 37 into position at the ends of the shell being formed.

By cutting the blank in the pattern shown in FIG. 9, with the cut lines at the edges of the supplemental areas 37,37 at each end of the shell overlapping with a portion of the adjacent end wall of the shell, the end wall areas 36,36 are each provided with projecting lugs 39 which serve as abutments or spacing elements establishing the interspacing between the upper edges of the side walls 38, thereby insuring the establishment of the desired flared configuration of the shell.

Preferably, a scoring effect is applied to the lines 33, 34 and 35, such score lines establishing a definite line for flexure of the areas of the blank forming the side and end walls of the shell. To facilitate folding and avoid undesirable creasing at corners, small cut-outs are provided, as indicated at 40, at the lower corners between the side and end walls of the blank.

Figure 15A:
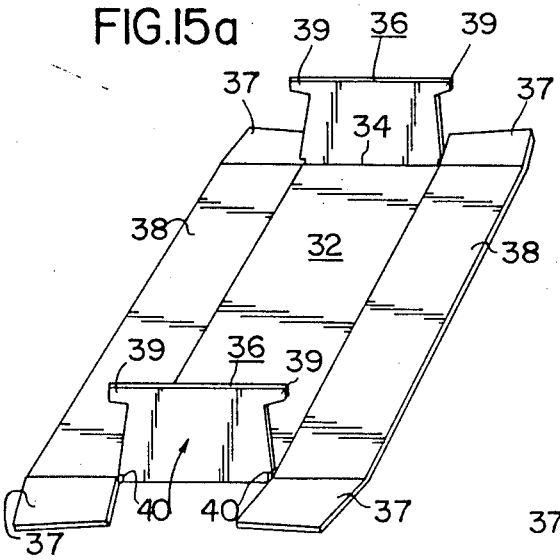
FIGS. 15*a* to 15*f* inclusive are views illustrating successive steps in the fabrication of a casket and lid according to the present invention; and in these figures.
Figure 15B:
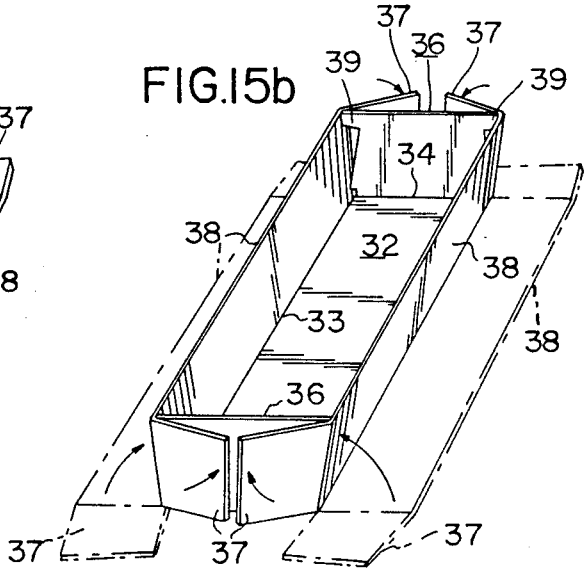
Figure 15C:
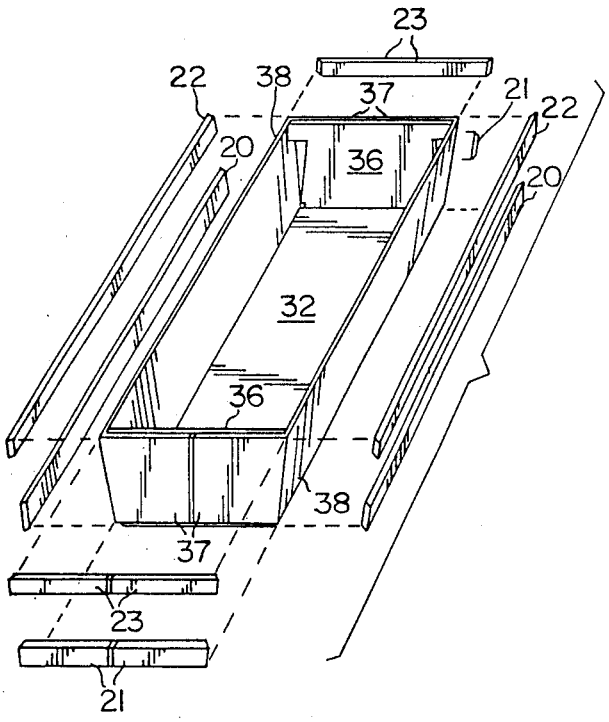

The foregoing not only provides complete bottom, side and end wall areas, but in addition, provides multiple thickness at the end walls which is desirable from the standpoint of establishing rigidity of the entire structure. When the blank is cut and folded in the manner as described above, the various areas in the end walls are desirably adhesively bonded to each other, after which further assembly may be performed, for instance, as in FIG. 15*c*. This illustrates the application of the framing elements 20, 21, 22 and 23. These framing elements may, if desired, be adhesively bonded to the corrugated fiberboard of the shell or base.

As hereinabove indicated, it is contemplated that the bottom, side and end walls of the shell be formed of corrugated fiberboard material; and while this material is not specifically shown in cross section in FIGS. 4 and 6, it will be understood that the walls of the shell are preferably formed from corrugated fiberboard sheet material, comprised of several laminated layers. A fragment of a typical material usable for this purpose is illustrated in FIG. 10, and it will here be seen that the material includes three corrugated layers 41, and four planar or sheet layers 42. When constructed in the manner above described and with the walls of the shell formed of material of the kind illustrated in FIG. 10, the shell has high structural strength, even without any substantial bracing. However, it is contemplated that at least one transverse brace, such as indicated at 43, be incorporated within the shell, this brace, as clearly shown in the drawings, having a flat transverse component extended across the bottom wall of the shell and having upwardly extending legs at opposite ends. The central escutcheon plates 28 at each side of the shell are desirably bolted to the transverse brace 43. Although the shell may have substantial inherent strength, even without any transverse braces, it is also contemplated that transverse braces 44 may be incorporated in positions toward the opposite ends of the shell, as seen in various of the figures, particularly FIG. 4.

It is still further contemplated that the shell be covered with cloth and fabric, and this would ordinarily be accomplished prior to installation of the escutcheon plates 28 and 30 at the ends of the shell.

It is here further pointed out that the use of the blank providing not only the end surfaces 36 for the shell but also the supplemental overlapping end surfaces 37—37 at each end of the shell, may be utilized effectively in facilitating the fabric covering of the shell. Thus, referring, for example, to FIG. 2, the fabric, which is diagrammatically indicated by decorative fabric lines in that figure, may be applied by winding a strip of the fabric from one end of the shell toward the other. Thus, assuming a strip of the fabric is applied to the shell beginning toward the right in FIG. 2 and extending toward the left, that strip may be extended over the left hand end of the shell, and then with the edge of a tool, may be pushed into the slot between the supplemental end wall elements 37—37. The projecting end of one such strip of fabric appears in FIG. 2 at 45; and after this is applied and the fabric secured in position, this end piece may be trimmed off. Adhesive may be employed in the application of the fabric.

Figure 11:
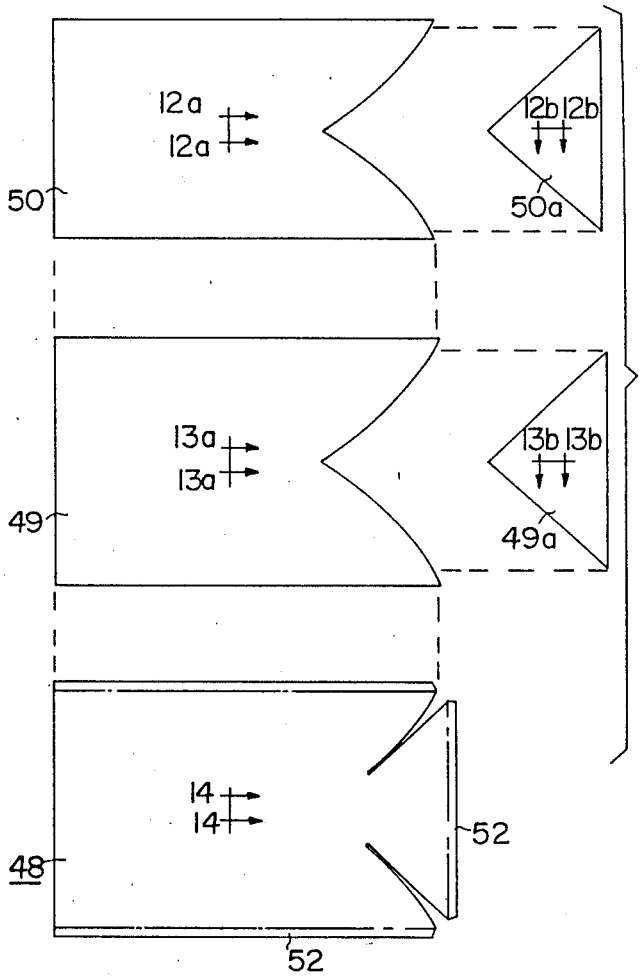
FIG. 11 is a view of a plurality of layers of material employed in the fabrication of a lid according to the invention.
Figure 12A:
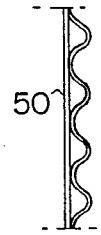
FIGS. 12*a*, 13*a* and 14 are enlarged sectional views taken as indicated by the section lines 12*a*—12*a*, 13*a*—13*a*, and 14—14, as applied to different portions of FIG. 11.
Figure 12B:
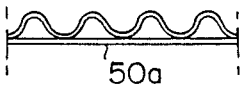
FIGS. 12*b* and 13*b* are enlarged sectional views taken as indicated by the lines 12*b*—12*b* and 13*b*—13*b* on FIG. 11.
Figure 13A:
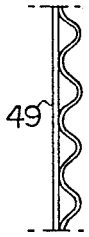
Figure 13B:
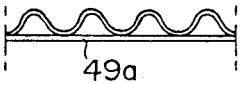
Figure 14:
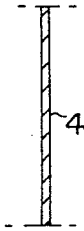
Figure 16:
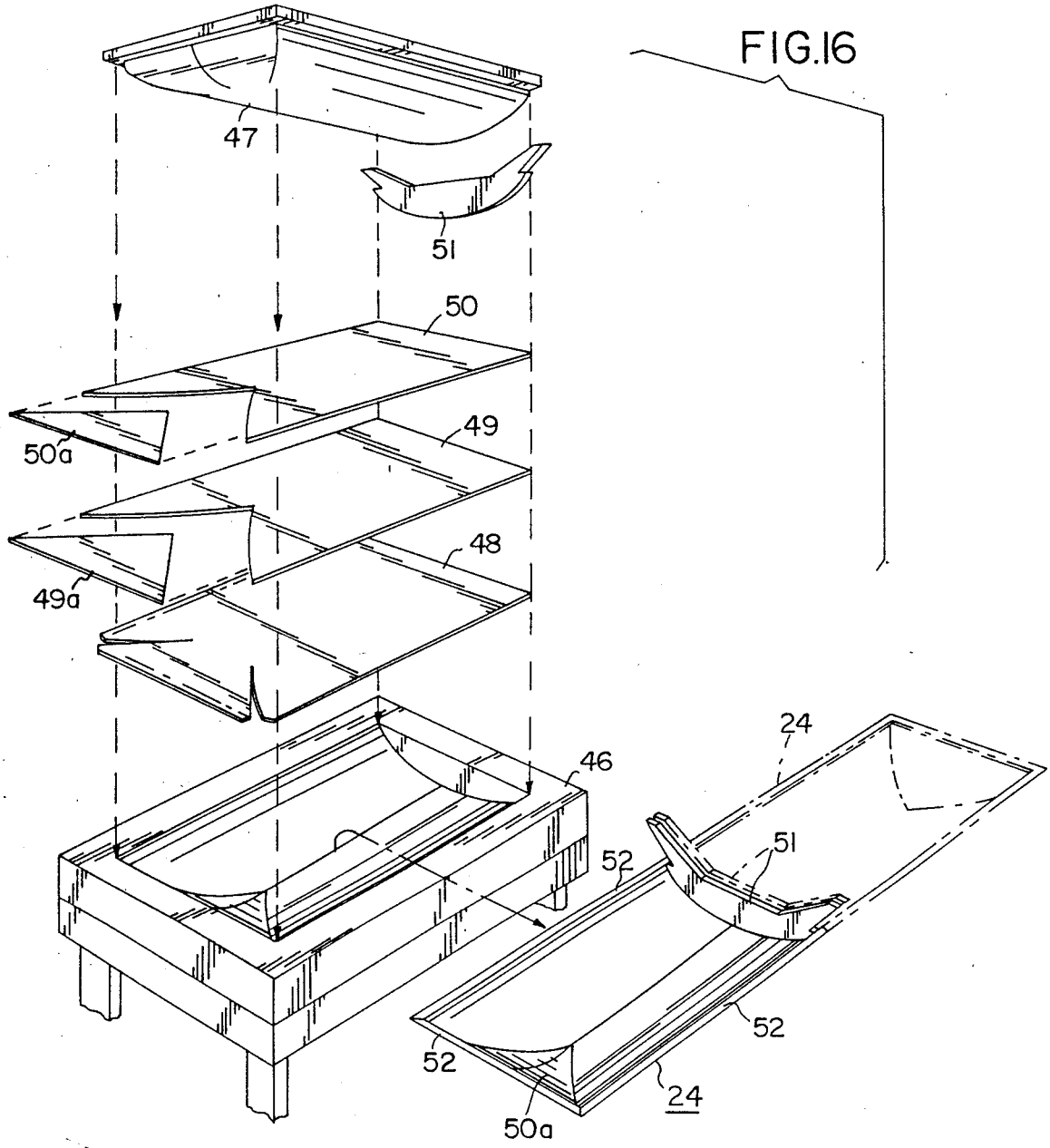
FIG. 16 is an exploded view of certain portions of a mold structure adapted for use in the molding of a domed lid according to the present invention, this view also showing the interposition of certain of the layers of corrugated fiberboard and plain sheet material adapted to be laminated in the mold, this view further indicating the separation or removal of a molded half-lid being separated from the mold.

As above indicated, it is contemplated that not only the shell of the casket but also the lid of the casket, may be formed at least in large part of corrugated fiberboard sheet material. In general, it is contemplated that the lid be of domed configuration, and a technique for fabrication of such a lid is particularly illustrated in FIGS. 11, 12*a*, 12*b*, 13*a*, 13*b*, 14 and 16. In general, it is contemplated that the domed lid be molded to the desired configuration; and in a preferred technique for molding such a lid, certain components are brought together in superimposed relationship and are then placed in a mold. In the embodiment shown in FIGS. 11 and 16, the molding is effected with respect to one half of a lid at a time, and two halves may be put together in order to form one complete lid. Referring more specifically to FIGS. 11 and 16, it is first pointed out that a plurality of layers of material are superimposed or stacked in the dome-shaped cavity of a base part 46 of a mold structure, as shown in FIG. 16. The mating convexly curved part of the mold structure is indicated at 47 toward the top of FIG. 16. A planar sheet, as indicated at 48 (see FIGS. 11, 14 and 16), is first placed in the mold. A corrugated sheet 49, comprising one planar sheet and one corrugated layer (see FIGS. 11, 13*a*, 13*b* and 16), is then placed upon the sheet 48. Another corrugated sheet 50, comprising one planar sheet and one corrugated layer (see FIGS. 11, 12*a*, 12*b* and 16), is then placed upon the sheet 49.

The components which are laminated in the domed lid also include the triangular pieces indicated at 49*a* and 50*a*, which are shaped to fit into the V-shaped cutout, which is provided in one end of each of the corrugated fiberboard sheets 49 and 50. Similarly, the sheet 48 (which is a planar sheet, rather than a corrugated sheet) has diagonal cut-outs in the corresponding corners; and this configuration, together with the use of the supplemental pieces 49*a* and 50*a*, provides for molding of the lid with a domed shape, not only transversely of the casket but also toward the end of the casket. This domed configuration at the ends clearly appears in FIGS. 1, 3 and 4.

As seen in FIGS. 12*a*, 12*b*, 13*a* and 13*b*, the corrugated fiberboard sheets employed for those parts include a single planar sheet and a single corrugated sheet prelaminated to each other. By employing sheets of this configuration, rather than a corrugated fiberboard having a planar sheet at each side of the corrugated sheet, the molding to the curved contour desired can be effected without distortion of the corrugated fiberboard.

From FIGS. 11 and 16, it will be seen that the mold structure and the molding operation is effected in a manner to produce a lid piece representing one half of the lid; and this half or "split" may be ultimately mounted independently of the other half of the lid, it being understood that the two halves employed for a complete lid are contemplated to be counterparts which are moldable in the same equipment and by the same technique as described above for the split lid.

Figure 7:
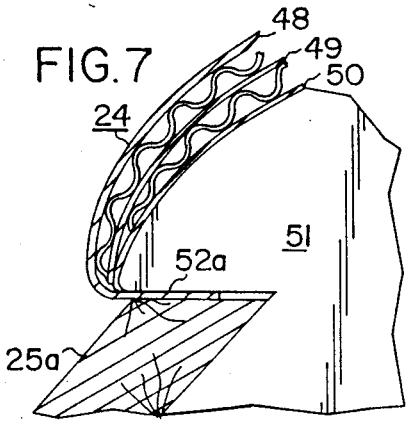
FIG. 7 is an enlarged detailed sectional view of a portion of the lid, taken as indicated by the dot-dash circle applied to FIG. 6.
Figure 8:
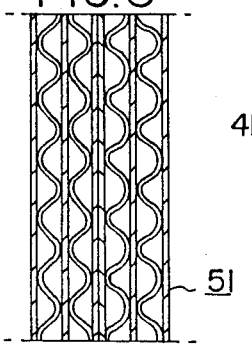
FIG. 8 is an enlarged transverse sectional view of a portion of a strengthening bridge employed in the lid, this view being taken as indicated by the section line 8—8 on FIG. 6.

In the molding operation, it is, of course, contemplated that adhesive will be used in order to integrate the various components of the lid. In addition, it is preferred to incorporate in the molded lid structure at least one transverse bridge of the type indicated at 51 (see particularly FIGS. 16, 4, 5, 6, 7 and 8). This bridge is desirably formed of a multiple-thickness corrugated fiberboard blank, for instance, having four corrugated sheets lying between various planar sheets and prelaminated together so as to form a bridge of substantial strength and rigidity. The corrugations of the corrugated sheets preferably are positioned so that the axes of the corrugations extend transversely of the lid. A fragment of the bridge also appears in the transverse sectional view of FIG. 7, which is an enlarged view taken as indicated in the dot-dash circle applied to the left upper portion of FIG. 6.

Figure 15D:
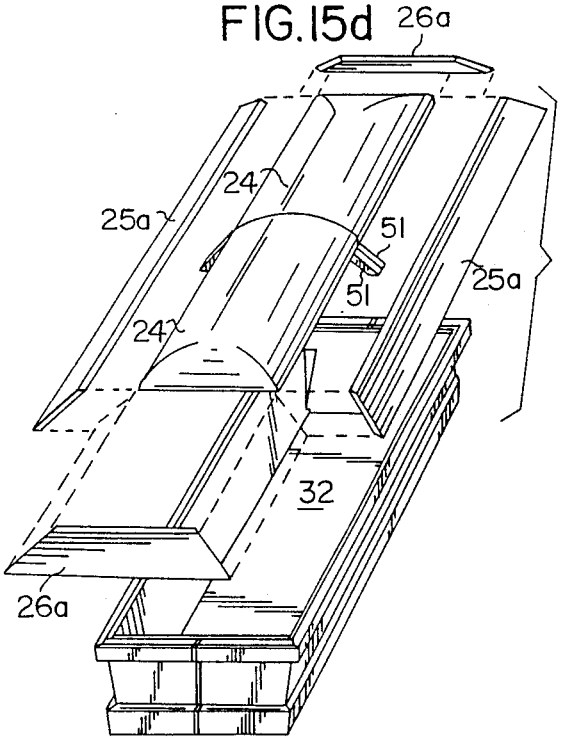
Figure 15E:
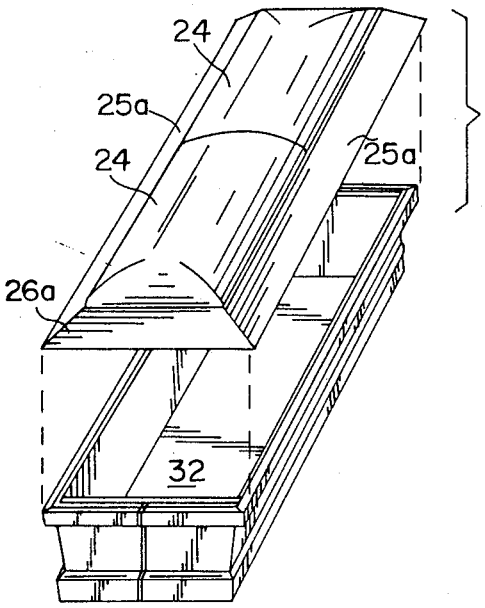
Figure 15F:
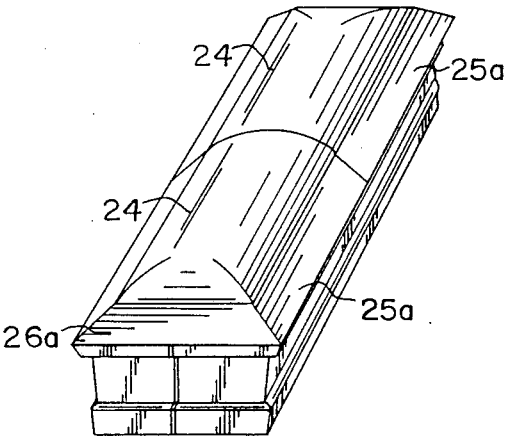

After the domed portion of the lid has been molded, two lid halves may then be assembled together in end-to-end relation, as indicated in FIG. 15*d*. The assembly of these lids brings the transverse bridge of each lid half adjacent to each other in the mid region. Preferably, the lid structure includes a marginal framing which may conveniently be applied in pieces. Thus, as seen in FIG. 15*d*, two side frame strips 25*a* and two end frame strips 26*a* are employed in order to make up the frame for the lid previously referred to. These may be appropriately connected and also joined to the molded dome of the lid, as by adhesive fastening. The lid prepared in this manner may be used as a single complete lid, as indicated in FIG. 15*e*; but if desired, the frame which has been applied in accordance with FIG. 15*d* may be cut transversely in a plane between the two transverse bridges 51, in order to provide a split lid, as illustrated in FIG. 15*f*.

In either technique, i.e., employment of the lid in a single piece or in split form, the lid or the lid halves may be covered with cloth or fabric on all surfaces.

Figure 17:
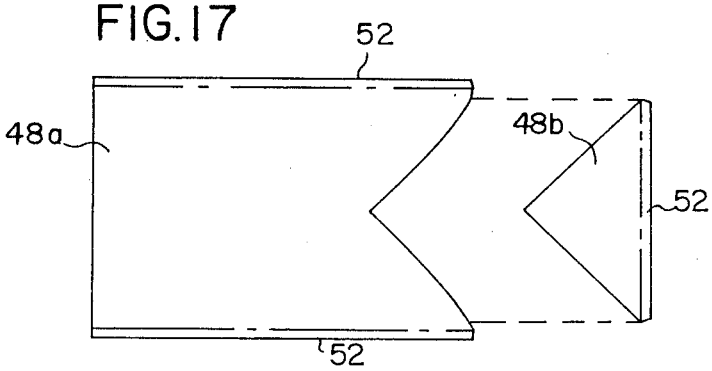
FIG. 17 is a view similar to FIG. 14 but illustating a modified embodiment of one portion of the material used in the fabrication of the lid.

FIG. 17 illustrates an alternative in the manufacture of the domed lid. This figure shows an alternative to the planar component shown at 48 in FIGS. 11 and 16. Here, the sheet 48*a* has a V-shaped cut-out in one end, and a separate triangular piece 48*b* is provided. With the configuration shown in FIG. 17 and also with the configuration shown in FIGS. 11 and 16, the planar sheet 48 (or 48*a*—48 *b*) has projecting marginal portions 52 adapted to be folded over the free edges of the enclosed corrugated fiberboard layers, as indicated at 52*a* in FIG. 7. These folded strips 52*a* thus lie between the transverse bridge 51 and the adjoining portions of the frame of the lid. This arrangement adds strength to the overall lid construction and also provides a smooth edge at the junction between the molded part of the lid and the lid frame.

In connection with the corrugated fiberboard pieces 49 and 49*a* and also 50 and 50*a*, as will be seen from the sectional views 13*a*—13*b* and 12*a*—12*b*, the axes of the corrugations in the end pieces of the lid are at right angles to the axes of the corrugations in the main portion of the lid. The reason for this is to avoid molding and flexure of these components in directions transverse to the axes of the corrugations. This minimizes distortion of the pieces being molded as a result of the molding in the domed configuration. In the principal portion of the lid, the domed configuration is arranged transversely of the casket and lid; but in the end portions of the lid, the domed configuration extends longitudinally of the lid and casket.

According to the foregoing, a relatively simple technque is provided for the fabrication of a casket and lid, the techniques being well adapted to the employment of readily available corrugated fiberboard sheet material. Various aspects of the configuration herein disclosed are of importance in providing a high degree of strength and rigidity, notwithstanding the fabrication of the base and lid, in large part, from the corrugated fiberboard.

The techniques also make possible the fabrication of a casket shell and casket lid of appropriate casket configuration, not only having a shell with flared walls, but also having a lid of domed configuration, both laterally and longitudinally of the casket.

The technique of the invention is also of special advantage in providing for manufacture of lids, either as complete lids or in split form, employing all of the same equipment and even the same components. Thus, upon fabrication of a complete lid, the lid may be used in that form or may readily be converted to split form, merely by cutting the lid framing in a transverse plane in the mid region between the bridges which are molded into the two halves.

Relatively low manufacturing costs and relatively low ultimate cost to users are also an advantage flowing from the techniques of the present invention.

I claim:

1. A casket base or shell having a planar bottom wall and outwardly flared planar side and end walls, all of which are integrally formed from a planar sheet of corrugated fiberboard, each side wall of the shell being unitary and planar throughout its length and each side wall of the shell being coextensive in length with the bottom wall and being integrally connected with the bottom wall along a side edge of the bottom wall throughout the length of the bottom wall, each end wall comprising two layers of the corrugated fiberboard, a first of which is integrally connected with the adjacent end of the bottom wall and a second of which comprises corrugated fiberboard pieces respectively integrally connected with the adjacent ends of the planar side walls and having edges adjacent to each other in the mid-region of the end wall, said first and said second end wall layers of the casket base being cut and folded so as to be mounted in outwardly flared position, and the pieces of said second end wall layer being cut and folded so as to mount the planar side walls of the gasket base in outwardly flared position when said edges are adjacent to each other in the mid region of the end wall of the casket base, whereby to provide a casket base having a substantially uniform and smooth external appearance throughout both the flared planar side walls and the flared planar end walls, and including a rim secured to the upper edge of the flared side and end walls, and further including fabric covering for the casket base including a strip extended along each side wall of the casket base and around a corner between the side wall and an end wall.

* * * * *